US005206451A

United States Patent [19]

Böcker

[11] Patent Number: 5,206,451

[45] Date of Patent: Apr. 27, 1993

[54] ARMOR-PROTECTION FOR A WALL, FOR EXAMPLE A BOMBSHELTER OR AN ARMORED VEHICLE

[75] Inventor: Jürgen Böcker, Oberhausen, Fed. Rep. of Germany

[73] Assignee: Rheinmetall GmbH, Dusseldorf, Fed. Rep. of Germany

[21] Appl. No.: 314,696

[22] Filed: Feb. 6, 1989

Related U.S. Application Data

[63] Continuation-in-part of Ser. No. 45,715, Apr. 16, 1987, abandoned, which is a continuation of Ser. No. 654,100, Aug. 22, 1984, abandoned.

[30] Foreign Application Priority Data

Sep. 28, 1983 [DE] Fed. Rep. of Germany ..... 3335002

[51] Int. Cl.[5] ..... F41H 5/007

[52] U.S. Cl. ..... 89/36.02; 89/36.17; 89/36.08; 109/15; 109/36; 109/81; 428/911

[58] Field of Search ..... 89/36.02, 36.03, 36.04, 89/36.08, 36.17, 40.03; 109/15, 36, 37, 64, 67, 76, 81; 428/911

[56] References Cited

U.S. PATENT DOCUMENTS 2,380,393 7/1945 Berg ..... 89/36.08

FOREIGN PATENT DOCUMENTS 1098412 7/1961 Fed. Rep. of Germany ..... 89/36.08

*Primary Examiner*—Stephen C. Bentley

*Attorney, Agent, or Firm*—Spencer, Frank & Schneider

[57] ABSTRACT

A wall of, for example, a bombshelter or armored vehicle, is provided with an inner and outer armor spaced from each other. This armor protection is designed to provide a deflection, respectively destruction of an impacting projectile as soon as the projectile nose has penetrated the outer armor. The arrangement is designed to permit only a relative minor destruction of the outer armor in the impacted region, so that those regions adjoining the impacted region maintain their protective structural integrity.

This object is achieved in that in the partial chambers which are divided by transverse walls defining closed intermediate chambers between both armors there is disposed a material insert which explodes or bursts as a result of the penetration of the projectile, for example, a material insert consisting of an explosive, glass or ceramic material. The outer armor consists of plates which are overlappingly arranged at one of the adjoining sides and which swing outwardly.

These plates can be suspended by means of hinges A on a post E of the outer armor and can be held in position by means of shear pins C at their opposite sides. The material insert G is disposed between the outer and inner armor.

4 Claims, 3 Drawing Sheets

ARMOR-PROTECTION FOR A WALL, FOR EXAMPLE A BOMBSHELTER OR AN ARMORED VEHICLE

CROSS REFERENCE TO RELATED APPLICATION.

This application is a Continuation-in-part application of our co-pending application Ser. No. 045,715 filed on Apr. 16, 1987 (now abandoned), which is a Continuation application of abandoned application Ser. No. 06/654,100, filed Aug. 22, 1984.

BACKGROUND OF THE INVENTION

The invention relates to armor-plating for a wall, for example a bombshelter or a housing of an armored vehicle which armor-plating consists of an inner armored wall and an outer armored wall spaced from said inner armored wall.

German patent No. 10 98 412 discloses inwardly easily pivotable plates for so-called "double armor". It is known from U.S. Pat. No. 2,380,393 to provide suspended armored plates which are adapted to yield in the plate plane. These known arrangements are designed to achieve a projectile-deflecting effect. This object has, however, not been satisfactorily achieved with these known arrangements. It has been observed that the desired effect, if achieved at all, occurs too late. With other known constructions having a double armor, material is provided between the two plates which, at projectile impact, causes the outer plate to be accelerated outwardly. This arrangement has the drawback that further impacting on the previously impacted area causes a complete destruction of the armor, whereby in addition thereto the direction of movement of the plate (s), occurs preponderantly in the flight direction of the projectile and therefore does not render a maximum protective effect.

SUMMARY OF THE INVENTION

It is therefore an object of this invention to provide a deflection and even destruction of a projectile, in particular a long projectile, instantaneously after the projectile nose has penetrated the outer armor. This deflection or destruction is introduced immediately after the penetration effect. The armor protection of the invention is designed to permit only a relative limited destruction of the outer armor in the impact region, so that repairs are easily achievable and that the adjoining regions of the impact area remain preponderantly in a structurally sound condition and their effective protection remains essentially intact.

The arrangement of the invention achieves a defined gaping of the plate which has been penetrated by the projectile. In particular long projectiles such as KE-ammunition (KE-ammunition means purely inertial projectiles containing no explosive which achieve their destructive effect by kinetic energy only) can only be destroyed or deflected by the swinging movement of the plate prior to the penetration of the impacted plate, so that its penetration capability is considerably reduced.

The location of the swing axis for the plates depends primarily from the corresponding configuration of the protective wall. For example if an armored vehicle or tank turret is involved, the protective wall has to have a corresponding shape. It is not necessary for the swing axis to be disposed horizontally or vertically; such axis can, for example, be also disposed on a skewed plane. The swing axis must be positioned so that the projectile is deflected away from the armor-protected chamber which is protected by a further amor-plating disposed behind this novel protective arrangement. In the event this novel protective principle is used in the form of a spatially separate module frontally disposed relative to a further armored wall then the swingable plates can also effectively be installed on the rear side of the module, for purposes of destroying or deflecting the existing remainder of the projectile.

BRIEF DESCRIPTION OF THE DRAWINGS

The above-described and other features and advantages of this invention will become more readily apparent from the following, reference being made to the accompanying drawing in which.

DETAILED DESCRIPTION

It is also possible to used in lieu of the illustrated hanging or suspension means an armor protection in the form of a plate which for purposes of being pivotally mounted about an axis is cut along three sides, so that this plate upon impact of a projectile swings outwardly about the fourth side which acts as pivotal supports and is formed by the material which remain intact. There can be also provided a material weakened zone on the remaining side for purposes of facilitating the outward swinging. In any case, the securing of the three other sides, for example by means of bolts or weakened welds, must, however, be more yieldable than the securing of the fourth side of the armor. The material disposed between the outer and inner armor should fill out completely the intermediate space between the outer and inner armor. If such filler material consists of an explosive material, however, only a reduced quantity of material is generally required, for example in the form of a narrow plate, which may then be mounted against the inner armor from the outside or against the outer armor from the inside.

Figure 1:
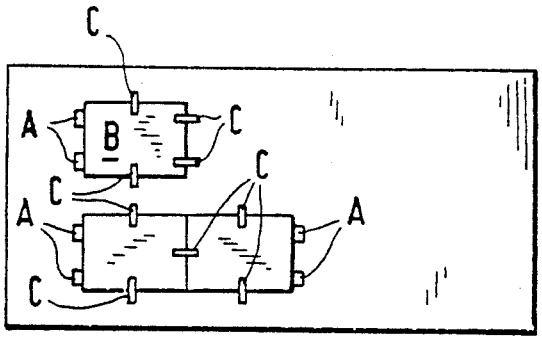
FIG. 1 is a plan view from above of an upper door B which has hinges A and locking bolts C; there is further disposed a two-wing door underneath the upper door B which also has hinges A and locking bolts C.
Figure 2:
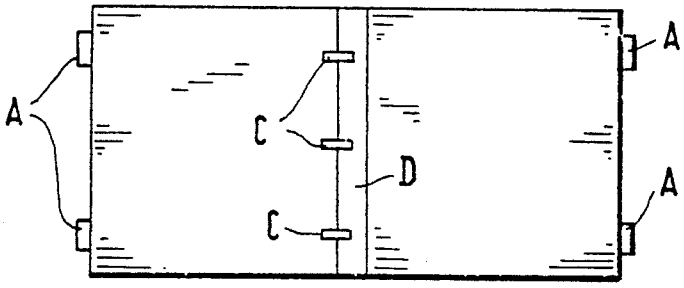
FIG. 2 is a plan view of two plates which have hinges A disposed at opposite sides and include locking bolts C and an overlap D at the adjoining sides of the two plates.
Figure 3:
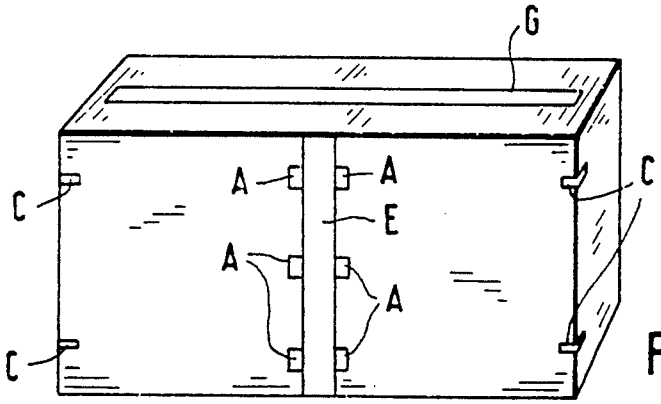
FIG. 3 is a perspective view of two plates mounted on a middle post E by means of hinges A, which include the locking means C at their exterior sides and on the top side a burst-insert G, for example made out of explosive material, glass or ceramic material disposed in the interior of the module illustrated in FIG. 3.
Figure 4:
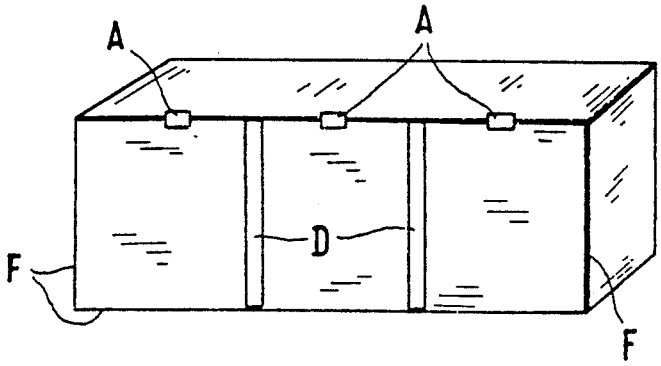
FIG. 4 illustrates also in perspective a module having suspension means disposed on the upper front edge of the three plates, and including overlaps D at the adjoining sides of the plates and a weakened weld F on the side edges and lower edges of the plates.
Figure 5:
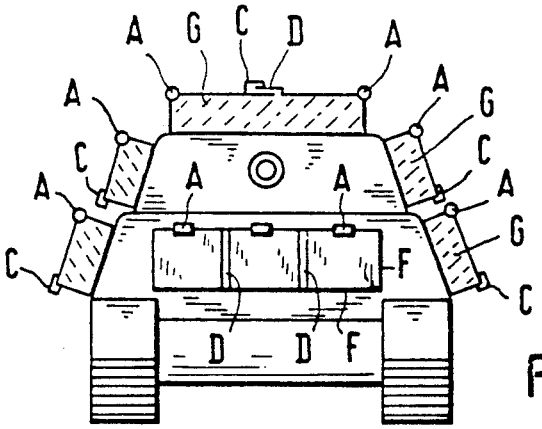
FIG. 5 is a front elevational schematic view of a tank having a plurality of modules which are constructed in accordance with this invention.
Figure 6:
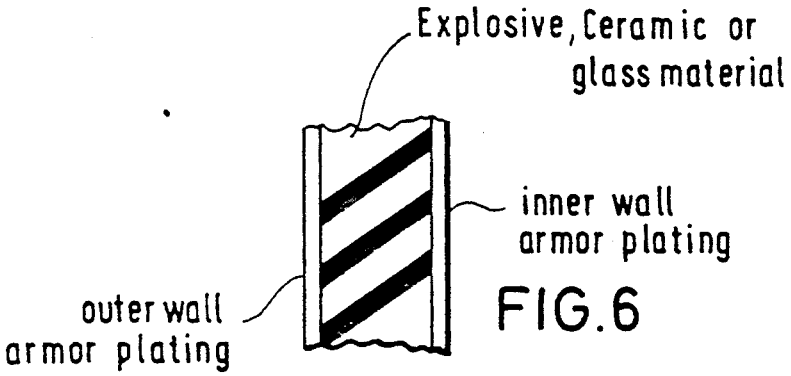
FIG. 6 is a cross-sectional view through a module of the armor protection of this invention.
Figure 7:
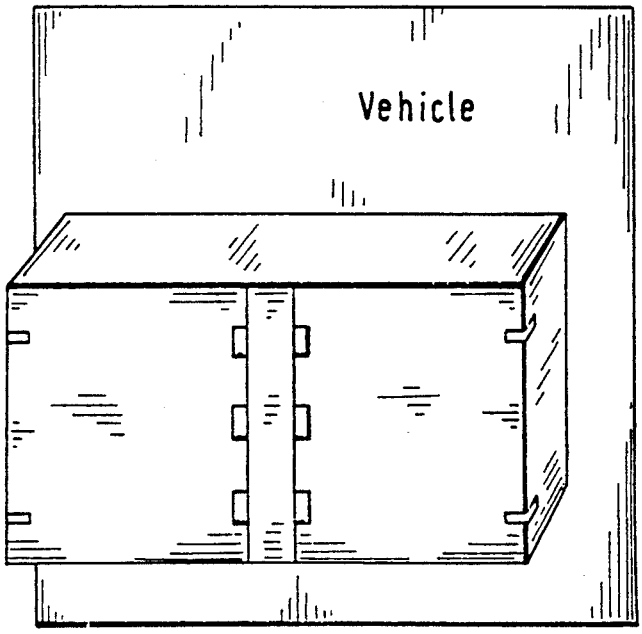
FIG. 7 is a schematic view of a module in accordance with this invention shown attached to an armored vehicle.
Figure 8:
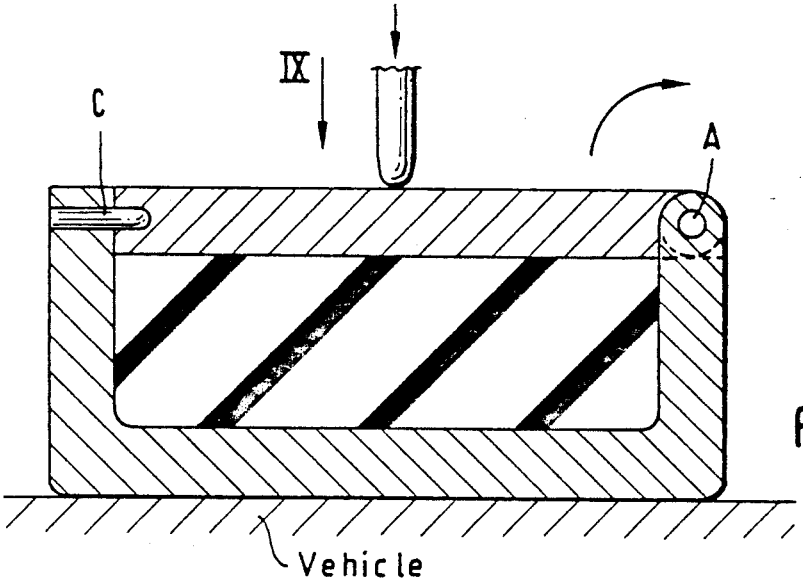
FIG. 8 is an enlarged cross-sectional view along line VIII—VIII in FIG. 9 of the upper module in accordance with this invention as illustrated in FIG. 1.
Figure 9:
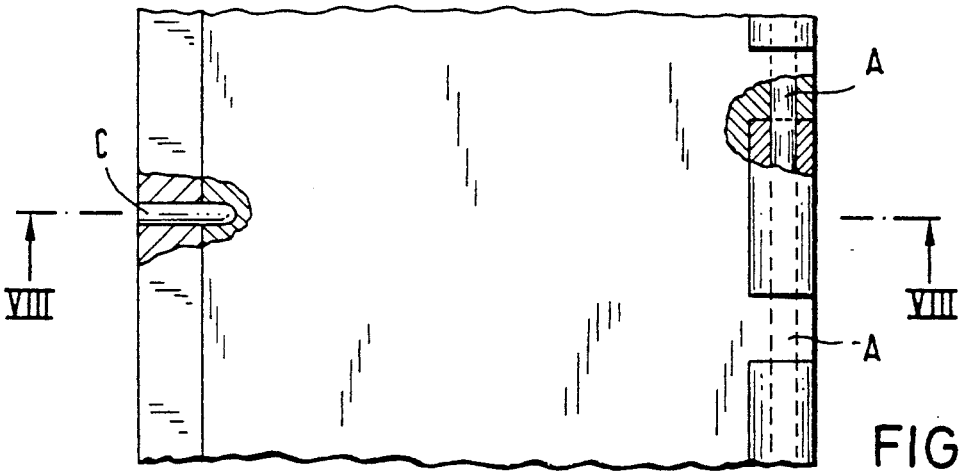
FIG. 9 is a top plan view of the module illustrated in FIG. 8.
Figure 10:
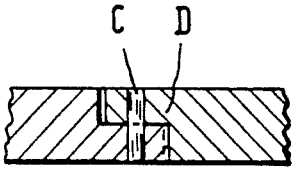
FIG. 10 is a cross-sectional enlarged view of a connection C-D as shown in the uppermost module in FIG. 5.
Figure 11:
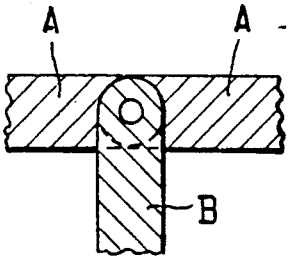
FIG. 11 is a cross-sectional view of a hinge mounting of the module of FIG. 3.

The various figures clearly illustrate, sometimes at an enlarged scale, the module-like construction of the armor protection forming part of this invention. In particular the drawings illustrate the manner in which the covers of the modules are mounted. For example, the hinges A are now clearly illustrated in FIGS. 8 and 9. As can be seen in FIGS. 8 and 9 there is mounted, opposite to the hinge A, a shear pin C. The shear pin C is mounted in such a way that, after a certain inner pressure has developed inside the module as a result of the module being impacted by means of a high-kinetic energy-projectile, this shear pin is sheared off. The cover, as a result of the strongly developing inner pressure within the module, as a result of the thereinto penetrating projectile and further as a result of the substantially incompressible inert mass inside the module, assumes an outward pivoting motion, as illustrated by the clockwise arrow in FIG. 8, as a result of the mounting on the hinges A. This mass can, for example, consist of glass, ceramic, or an explosive substance. Consequently, the projectile, in particular when it is impacting normally relative to the cover of the module, is substantially inhibited in its flight direction and its penetration energy is substantially consumed by the outwardly accelerating mass of the cover. As a result of the pivoting movement the impacting projectile (see FIG. 8) it is immediately deflected from its original flight direction. Consequently, the position of the points of contact between the projectile and the outwardly pivoting cover continuously change so that the projectile cannot penetrate along a direct path into the cover but rather the penetration process of the projectile is inhibited in an energy consuming manner by means of the lagging cover material. This form of an armor protection can therefore be designated as an "active armor" or also as a "reactive armor".

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. An improved kinetic energy projectile deflecting armor protection for an armored wall, the improvement comprising, an armored wall;

armor protection module means operatively mounted on said armored wall; said module means having two pairs of side walls and a cover which is pivotally mounted on one of said side walls and extends contiguous to the opposite side wall of one of said two pairs of side walls or contiguous to an other pivotally mounted cover, whereby each module defines an inner space by means of said cover and said two pairs of side walls;

shear pins means detachably securing said cover to said opposite side wall or said contiguous cover;

the inner space of each module means being filled with a substantially incompressible material which bursts out or explodes upon being impacted by said projectile;

said material being selected from an explosive, glass and ceramic material, whereby when said cover is impacted on by a projectile, said material in said inner space produces an increasing outward pressure on said cover to such extent that it pivots said cover outwardly after shearing said pin means to thereby act in a kinetic energy consuming manner on said impacting projectile.

2. The armor-protection for a wall as set forth in claim 1, wherein there are two pivotally mounted covers which overlappingly adjoin each other at one of their sides in an overlap zone D, said covers being respectively pivotally mounted by means of hinges A at the sides opposite to said overlap zone D.

3. The armor-protection for a wall as set forth in claim 2, wherein there are operatively mounted a plurality of covers which overlappingly adjoin each other at one of their sides in overlap zones D, each cover being pivotally suspended by means of at least one hinge A.

4. The armor-protection for a wall as set forth in claim 1, wherein said module includes transverse wall means which join said two pairs of side walls so as to form a box-construction.

* * * * *